US009522723B1

(12) United States Patent
Andrasko et al.

(10) Patent No.: US 9,522,723 B1
(45) Date of Patent: Dec. 20, 2016

(54) SYSTEMS AND METHODS FOR CONTROLLING MOVEMENT OF DRIVE UNITS ON A MARINE VESSEL

(71) Applicant: Brunswick Corporation, Lake Forest, IL (US)

(72) Inventors: Steven J. Andrasko, Oshkosh, WI (US); Kenneth G. Gable, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 15/143,783

(22) Filed: May 2, 2016

Related U.S. Application Data

(62) Division of application No. 14/177,762, filed on Feb. 11, 2014, now Pat. No. 9,359,057.

(60) Provisional application No. 61/783,140, filed on Mar. 14, 2013.

(51) Int. Cl.
*B63H 25/02* (2006.01)

(52) U.S. Cl.
CPC ..... *B63H 25/02* (2013.01); *B63H 2025/028* (2013.01)

(58) Field of Classification Search
None
See application file for complete search history.

(56) References Cited

U.S. PATENT DOCUMENTS 3,707,939 A * 1/1973 Berg ..... B63H 5/125 440/58
5,085,603 A * 2/1992 Haluzak ..... B63H 20/34 440/51
5,685,253 A * 11/1997 Alexander, Jr. ..... B63B 1/18 114/271
6,234,853 B1 * 5/2001 Lanyi ..... B63H 21/213 114/144 R
6,276,977 B1 * 8/2001 Treinen ..... B63H 20/12 114/150
6,994,046 B2 * 2/2006 Kaji ..... B63H 25/42 114/144 R
7,150,664 B1 * 12/2006 Uppgard ..... B63H 20/12 440/53

(Continued)

OTHER PUBLICATIONS

Savitsky & Brown, Procedures for Hydrodynamic Evaluation of Planing Hulls in Smooth and Rough Waters, Marine Technology, Oct. 1976, pp. 381-400, vol. 13, No. 4.

*Primary Examiner* — Truc M Do
(74) *Attorney, Agent, or Firm* — Andrus Intellectual Property Law, LLP

(57) ABSTRACT

A method for controlling movement of drive units on a marine vessel includes receiving an operator request for a desired steering angle. A first drive unit's steering angle is set equal to the desired steering angle. A midpoint of a wetted surface area of the vessel hull is determined and a pivot line extending laterally through the midpoint and perpendicular to the hull's longitudinal axis is defined. A first intersection point of the pivot line and a line extending horizontally through the first drive unit's steering axis and parallel to the longitudinal axis and a second intersection point of the pivot line and a line representing perpendicular application of hydrodynamic force on the first drive unit are determined. A second drive unit's steering angle is set such that a line representing perpendicular application of hydrodynamic force on the second drive unit intersects the pivot line at the second intersection point.

20 Claims, 7 Drawing Sheets

(56) References Cited

U.S. PATENT DOCUMENTS 7,255,616 B1 * 8/2007 Caldwell ..... B63H 5/125 114/144 R
7,311,571 B1 * 12/2007 Swan ..... B63H 20/12 440/53
7,416,458 B2 * 8/2008 Suemori ..... B63H 21/22 114/144 R
7,429,202 B2 * 9/2008 Yazaki ..... B63H 21/213 114/144 R
7,467,595 B1 * 12/2008 Lanyi ..... B63H 21/213 114/144 R
7,883,383 B2 * 2/2011 Larsson ..... B63H 21/213 440/1
8,512,085 B1 * 8/2013 Kobilic ..... B63H 20/12 114/144 R
9,120,548 B2 * 9/2015 Nakayasu ..... B63H 21/21
9,132,903 B1 * 9/2015 Gable
2006/0240720 A1 * 10/2006 Yamashita ..... B63H 21/213 440/1
2007/0089654 A1 * 4/2007 Bradley ..... B63H 25/42 114/10
2007/0089660 A1 * 4/2007 Bradley ..... B63H 25/42 114/144 A
2009/0101057 A1 * 4/2009 Mueller ..... B63H 21/213 114/286
2010/0145558 A1 * 6/2010 Kaji ..... B63H 25/02 701/21
2010/0151750 A1 * 6/2010 Ito ..... B63H 20/12 440/1
2010/0191396 A1 * 7/2010 Nose ..... B63H 25/42 701/21
2010/0191397 A1 * 7/2010 Nose ..... B63H 25/42 701/21
2010/0256845 A1 * 10/2010 Mizutani ..... B63H 23/02 701/21
2011/0010028 A1 * 1/2011 Mizutani ..... B63H 25/00 701/21
2011/0028057 A1 * 2/2011 Torr ngs ..... B63H 20/12 440/53
2011/0153125 A1 * 6/2011 Arbuckle ..... B63B 39/00 701/21
2011/0166724 A1 * 7/2011 Hiramatsu ..... B63H 21/213 701/21

* cited by examiner

SYSTEMS AND METHODS FOR CONTROLLING MOVEMENT OF DRIVE UNITS ON A MARINE VESSEL

CROSS-REFERENCE TO RELATED APPLICATION

This application is a divisional of U.S. patent application Ser. No. 14/177,762, filed Feb. 11, 2014, now U.S. Pat. No. 9,359,057, issued Jun. 7, 2016, which claims the benefit of U.S. Provisional Patent Application No. 61/783,140, filed Mar. 14, 2013, both of which are hereby incorporated by reference in entirety.

FIELD

The present disclosure relates to marine vessels, and more particularly to systems and methods for steering a plurality of drive units on a marine vessel.

BACKGROUND

The disclosure of U.S. Pat. No. 7,150,664 is hereby incorporated by reference and discloses a steering actuator system for an outboard motor that connects an actuator member to guide rails, which are, in turn, attached to a motive member such as a hydraulic cylinder. The hydraulic cylinder moves along a first axis with the guide rail extending in a direction perpendicular to the first axis. An actuator member is movable along the guide rail in a direction parallel to a second axis and perpendicular to the first axis. The actuator is member is attached to a steering arm of the outboard motor.

The disclosure of U.S. Pat. No. 7,255,616 is hereby incorporated herein by reference and discloses a steering system for a marine propulsion device that eliminates the need for two support pins and provides a hydraulic cylinder with a protuberance and an opening which cooperate with each other to allow a hydraulic cylinder's system to be supported by a single pin for rotation about a pivot axis. The single pin allows the hydraulic cylinder to be supported by an inner transom plate in a manner that it allows it to rotate in conformance with movement of a steering arm of a marine propulsion device.

The disclosure of U.S. Pat. No. 7,467,595 is hereby incorporated herein by reference and discloses a method for controlling the movement of a marine vessel including rotating one of a pair of marine propulsion devices and controlling the thrust magnitudes of two marine propulsion devices. A joystick is provided to allow the operator of the marine vessel to select port-starboard, forward-reverse, and rotational direction commands that are interpreted by a controller which then changes the angular position of at least one of a pair of marine propulsion devices relative to its steering axis.

The disclosure of U.S. Pat. No. 8,512,085 is hereby incorporated herein by reference and discloses a tie bar apparatus for a marine vessel having at least first and second marine drives. The tie bar apparatus comprises a linkage that is geometrically configured to connect the first and second marine drives together so that during turning movements of the marine vessel, the first and second marine drives steer about respective first and second vertical steering axes at different angles, respectively.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In example disclosed herein, a system for controlling movement of a plurality of drive units on a marine vessel comprises a control circuit communicatively connected to each drive unit in the plurality of drive units. When the marine vessel is turning, the control circuit defines one of the drive units in the plurality of drive units as an inner drive unit and another of the drive units in the plurality of drive units as an outer drive unit. The control circuit calculates an inner drive unit steering angle and an outer drive unit steering angle and sends control signals to actuate the inner and outer drive units to the inner and outer drive unit steering angles, respectively, so as to cause each of the inner and outer drive units to incur substantially the same hydrodynamic load while the marine vessel is turning. An absolute value of the outer drive unit steering angle is less than an absolute value of the inner drive unit steering angle.

In a further example, a method for controlling movement of a plurality of drive units on a marine vessel includes communicatively connecting a control circuit to each drive unit in the plurality of drive units. The method further includes defining one of the drive units in the plurality of drive units as an inner drive unit and another of the drive units in the plurality of drive units as an outer drive unit when the marine vessel is turning. The method includes calculating an inner drive unit steering angle and an outer drive unit steering angle and sending control signals to actuate the inner and outer drive units to the inner and outer drive unit steering angles, respectively, so as to cause each of the inner and outer drive units to incur substantially the same hydrodynamic load while the marine vessel is turning. An absolute value of the outer drive unit steering angle is less than an absolute value of the inner drive unit steering angle.

In a further example, a method for controlling movement of a plurality of drive units on a marine vessel having a hull with a horizontally extending longitudinal axis, each drive unit having a vertically extending steering axis, includes receiving an operator request for a desired steering angle, defining one of the drive units in the plurality as an inner drive unit based on the desired steering angle, and setting a steering angle of the inner drive unit equal to the desired steering angle. The method further includes determining a midpoint of a wetted surface area of the hull and defining a pivot line extending laterally through the midpoint and perpendicular to the longitudinal axis. The method includes calculating a first intersection point of the pivot line and a line extending through the steering axis of the inner drive unit and parallel to the longitudinal axis. The method includes calculating a second intersection point of the pivot line and a line representing perpendicular application of a hydrodynamic force on the inner drive unit, and calculating steering angles for each remaining drive unit in the plurality such that lines representing perpendicular application of hydrodynamic force on each remaining drive unit in the plurality intersect the pivot line at the second intersection point. The method also includes sending control signals to actuate each drive unit in the plurality to its respective steering angle.

According to another example, a method for controlling movement of drive units on a marine vessel having a hull with a horizontally extending longitudinal axis and each drive unit having a respective vertically extending steering axis includes receiving an operator request for a desired steering angle. The method includes setting a steering angle of a first drive unit equal to the desired steering angle. The method also includes determining a midpoint of a wetted surface area of the hull and defining a pivot line extending laterally through the midpoint and perpendicular to the longitudinal axis. The method includes determining a first intersection point of the pivot line and a line extending horizontally through the first drive unit's steering axis and parallel to the longitudinal axis and determining a second intersection point of the pivot line and a line representing perpendicular application of hydrodynamic force on the first drive unit. A steering angle of a second drive unit is set such that a line representing perpendicular application of hydrodynamic force on the second drive unit intersects the pivot line at the second intersection point. The method includes sending control signals to actuate the first and second drive units to their respective steering angles.

In another example, a method for controlling movement of drive units on a marine vessel having a hull with a horizontally extending longitudinal axis and each drive unit having a respective vertically extending steering axis includes receiving an operator request for a desired steering angle and defining one of the drive units as an inner drive unit based on the desired steering angle. The method includes setting a steering angle of the inner drive unit equal to the desired steering angle. The method also includes determining a midpoint of a wetted surface area of the hull and defining a pivot line extending laterally through the midpoint and perpendicular to the longitudinal axis. The method includes calculating a first intersection point of the pivot line and a line extending horizontally through the inner drive unit's steering axis and parallel to the longitudinal axis, and calculating an effective radius of rotation of the inner drive unit using the desired steering angle and a horizontal distance between the inner drive unit's steering axis and the first intersection point. The method includes calculating a steering angle for another drive unit using the inner drive unit's effective radius of rotation and a separation distance between the inner drive unit and the other drive unit. The method next includes sending control signals to actuate the inner drive unit and the other drive unit to their respective steering angles.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed. The different systems and methods described herein may be used alone or with other systems and methods known to those having ordinary skill in the art.

Figure 1:
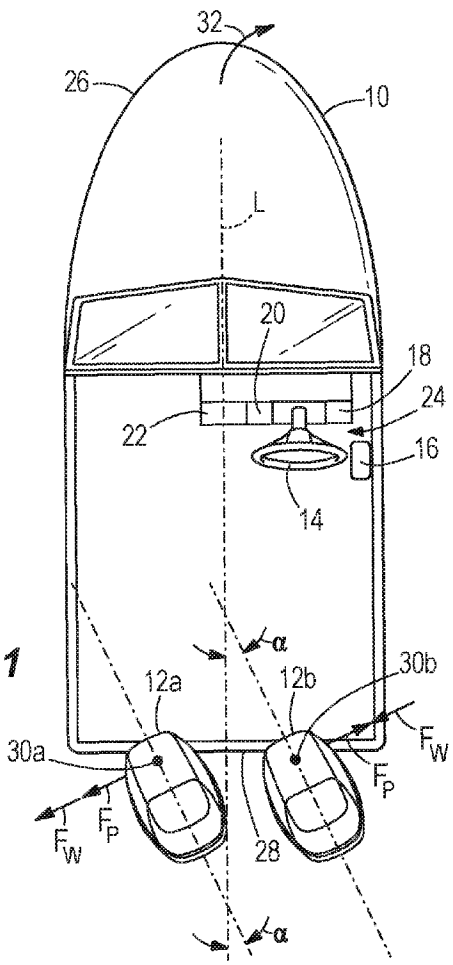
FIG. 1 is a schematic depiction of a marine vessel having a plurality of drive units and user input devices.

FIG. 1 schematically depicts a marine vessel 10 having a plurality of drive units 12*a*, 12*b*. In the example shown, the drive units 12*a*, 12*b* are shown coupled to the stern 28 of the marine vessel 10. The drive unit 12*a* is a port drive unit and the drive unit 12*b* is a starboard drive unit. The marine vessel 10 further comprises at least one user input device. In the example shown, the at least one user input device comprises a steering wheel 14, throttle lever 16, joystick 18, keypad 20, or touch screen 22. Each of these user input devices is located at a helm 24 of the marine vessel. Although not shown herein, each of these user input devices is communicatively connected to the drive units 12*a*, 12*b* to control steering angles, trim positions, engine speeds, and other functions of the drive units 12*a*, 12*b*. Together, the user input devices 14, 16, 18, 20, 22 and the drive units 12*a*, 12*b* comprise part of a control circuit 34 (FIG. 3) as will be described further herein below.

A longitudinal axis L extends generally horizontally down the middle of the marine vessel 10 from the bow 26 to the stern 28. In the example shown, one drive unit 12*a*, 12*b* is provided on either side of the longitudinal axis L. Each drive unit 12*a*, 12*b* is steerable about a vertical steering axis 30*a*, 30*b*. The vertical steering axes 30*a*, 30*b* extend generally perpendicularly to the horizontally extending longitudinal axis L. In one example, the drive units 12*a*, 12*b* are positionable about their respective steering axes 30*a*, 30*b* by steering actuators 48*a*, 48*b* (FIG. 3).

In the example shown, the drive units 12*a*, 12*b* are outboard motors, and as such, their steering axes 30*a*, 30*b* are somewhat longitudinally removed from the stern 28 of the marine vessel 10. However, it should be understood that the present disclosure applies equally to stern drives, pod drives, or any other drives capable of being steered according to a steer-by-wire system. The calculations described as part of the methods disclosed herein below are easily manipulable by those of skill in the art to apply the principles of the present method to such pod drives, stern drives, etc., which may have steering axes in different locations than those shown herein.

Figure 3:
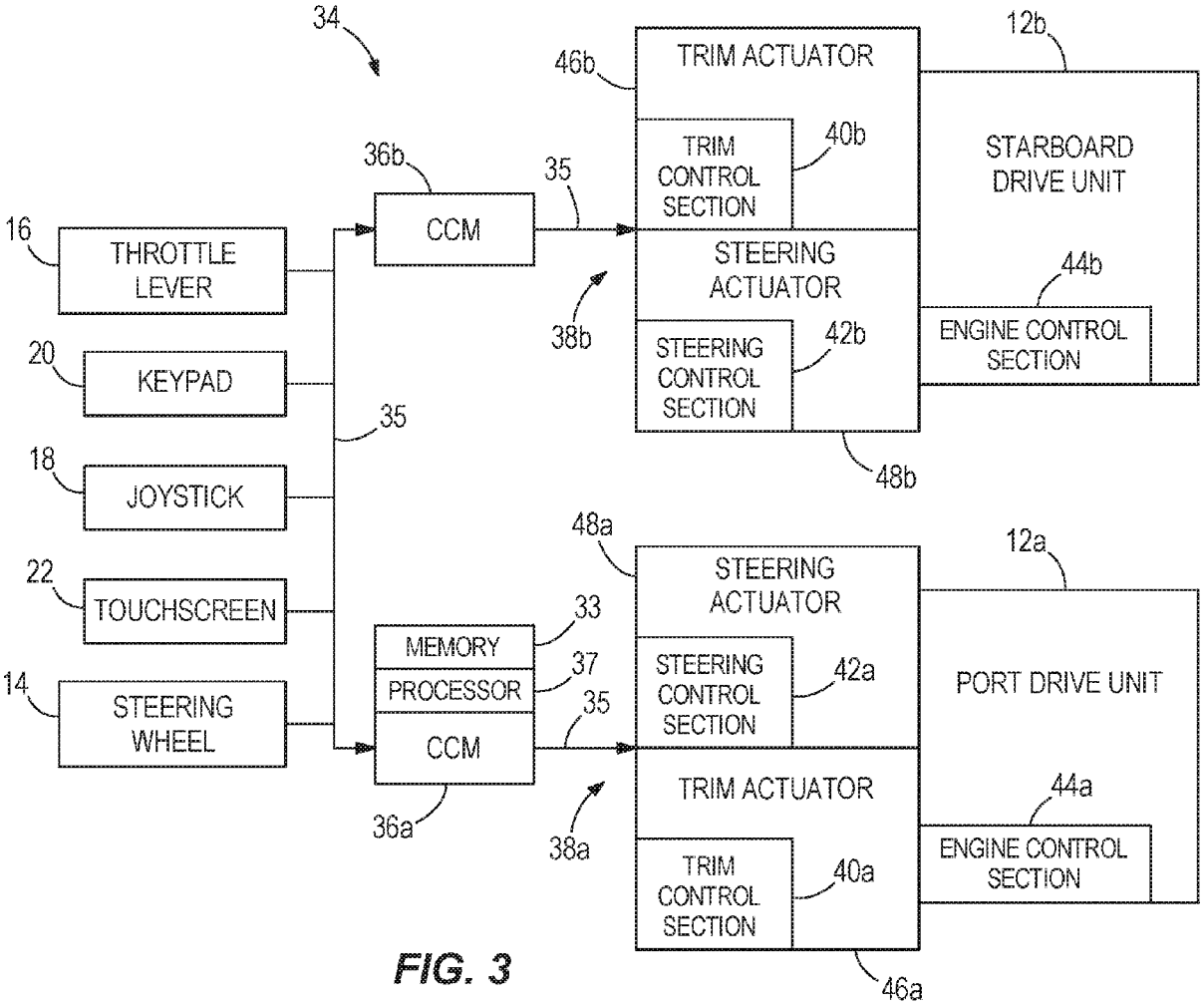
FIG. 3 is a schematic depiction of a control circuit for controlling movement of a plurality of drive units.

FIG. 3 shows a control circuit 34 for controlling operations aboard the marine vessel 10. In the example, the control circuit 34 includes user input devices, such as the throttle lever 16, keypad 20, joystick 18, touch screen 22, and steering wheel 14. Each of these user input devices 14, 16, 18, 20, 22 inputs commands via a controller area network (CAN) bus 35 to one of a port command control module (CCM) 36*a* and a starboard CCM 36*b*. Each of the CCMs 36*a*, 36*b* comprises a helm control section for interpreting signals sent from the input devices at the helm 24, processing the signals, and sending them to the drive units 12*a*, 12*b* for further processing by further electronic control units. For example, the CCMs 36*a*, 36*b* send signals to a plurality of trim control sections 40*a*, 40*b*; steering control sections 42*a*, 42*b*; and engine control sections 44*a*, 44*b*. In the example shown, the trim control sections 40*a*, 40*b* and steering control sections 42*a*, 42*b* are located together in thrust vector modules (TVM) 38*a*, 38*b*. The engine control sections 44*a*, 44*b* control the engines of each drive unit 12*a*, 12*b* and the trim control sections 40*a*, 40*b* control trim actuators 46*a*, 46*b*, which move the drive units 12*a*, 12*b* to a requested trim position in response to signals sent from the user input devices via the CCMs 36*a*, 36*b*.

The exemplary system shown is a "steer-by-wire" system, in which a desired steering angle is input to (or generated by) the CCMs 36*a*, 36*b*; the CCMs 36*a*, 36*b* send steering control signals to the steering control sections 42*a*, 42*b*; and the steering control sections 42*a*, 42*b* control the steering actuators 48*a*, 48*b* to actuate the drive units 12*a*, 12*b* to their respective steering angles. The steering actuators 48*a*, 48*b* position the drive units 12*a*, 12*b* according to the systems, devices, and methods disclosed in U.S. Pat. Nos. 7,150,664; 7,255,616; and 7,467,595, which were incorporated by reference hereinabove. For example, the steering actuators 48*a*, 48*b* may be hydraulic steering actuators operating according to the principles described in those patents. In other examples, the steering actuators 48*a*, 48*b* may be electric motors or pneumatic actuators.

The desired steering angle may be input to the CCMs 36*a*, 36*b* by manipulation of the steering wheel 14, joystick 18, and/or any other of the above-listed user input devices. The marine vessel 10 may also be equipped with autopilot, waypoint tracking, station-keeping, and/or yaw rate control capabilities, in which the desired steering angle may be generated by the control circuit 34. These modes may be initiated by selection of the appropriate buttons on the keypad 20 or touch screen 22 and/or by manipulation of other user input devices according to the programming of the system. These modes are generally known and will therefore not be described further herein. The control circuit 34 may operate using desired steering angles generated by carrying out any of these modes. For example, an autopilot system contained within one of the CCMs 36*a*, 36*b* (or as a separate unit) may output a desired steering angle. In another example, a yaw rate controller may output a desired steering angle. It should therefore be understood that the origins of the desired steering angle described herein are not limiting on the scope of the present disclosure.

In the example shown, although separate control modules such as the CCMs 36*a*, 36*b* and TVMs 38*a*, 38*b* are illustrated, it should be understood that any of the control sections shown and described herein could be provided in fewer modules or more modules than those shown. Further, it should be understood by those having skill in the art that a CAN bus 35 need not be provided, and that these devices could instead be wirelessly connected (or connected by a different communication system) to one another.

Any of the control modules may have a memory and a programmable processor, such as processor 37 in CCM 36*a*. As is conventional, the processor 37 can be communicatively connected to a computer readable medium that includes volatile or nonvolatile memory upon which computer readable code (software) is stored. The processor 37 can access the computer readable code on the computer readable medium, and upon executing the code can send signals to carry out functions according to the methods described herein below. Execution of the code allows the control circuit 34 to control a series of actuators (for example steering actuators 48*a*, 48*b*) of the drive units 12*a*, 12*b*. Processor 37 can be implemented within a single device but can also be distributed across multiple processing devices or sub-systems that cooperate in executing program instructions. Examples include general purpose central processing units, application specific processors, and logic devices, as well as any other type of processing device, combinations of processing devices, and/or variations thereof. The control circuit 34 may also obtain data from sensors aboard the vessel, and the processor 37 may save or interpret the data as described herein below. In the example shown, at least the port CCM 36*a* comprises a memory 33 (such as, for example, RAM or ROM), although the other control modules could be provided with a memory as well.

Referring back to FIG. 1, the drive units 12*a*, 12*b* are shown in an orientation that will cause the marine vessel 10 to turn to starboard, as shown by the arrow 32. To achieve such a turn, present steer-by-wire systems orient both drive units 12*a*, 12*b* in the same rotational direction (in this case, counterclockwise when viewed from above) to the same steering angle $\alpha$ with respect to the longitudinal axis L. When an operator inputs a desired steering angle at the helm 24, for example by turning the steering wheel 14 and/or manipulating the joystick 18, this desired steering angle is conveyed to steering control sections 42*a*, 42*b* of the drive units 12*a*, 12*b*. Both drive units 12*a*, 12*b* are thereafter oriented to the desired steering angle, in this example, to the same steering angle $\alpha$.

In the example shown, the drive units 12*a*, 12*b* may operate in a joysticking mode, described in U.S. Pat. No. 7,467,595, incorporated by reference hereinabove. While in joysticking mode, the steer-by-wire system may orient the drive units 12*a*, 12*b* independently of one another and to differing steering angles in response to manipulation of the joystick 18. In order to allow such independent orientation while in joysticking mode, the drive units 12*a*, 12*b* are not connected by tie bar, as is common with drive units (especially outboard motors) when more than one drive unit is provided. A tie bar traditionally distributes steering loads between the drive units. This load distribution is absent upon removal of the tie bar in order to allow for independent rotation of the drive units 12*a*, 12*b* while in joysticking mode.

Joysticking mode is generally used for slower, more precise movements of the marine vessel 10, such as when the marine vessel 10 is docking. In such conditions, relatively low forces and pressures are required from the steering actuators 48*a*, 48*b* to steer the drive units 12*a*, 12*b* to independent, different steering angles to achieve precise movement and rotation of the marine vessel 10. However, in current systems, even when the marine vessel 10 is operating at a higher speed, present steer-by-wire joysticking systems orient both drive units 12*a*, 12*b* as if they were still connected by a tie bar, for example, by steering both drive units 12*a*, 12*b* to the same drive angle $\alpha$ as shown in FIG. 1. In other words, present systems that allow for independent steering while at lower speeds default to steering all drive units 12*a*, 12*b* to the same steering angle with respect to the longitudinal axis L even when at higher speeds.

Through research and development, the present inventors have realized that orienting the drive units 12*a*, 12*b* to the same steering angle $\alpha$ as if they are connected by a tie bar causes the drive units 12*a*, 12*b* to incur unequal hydrodynamic loads, especially while the marine vessel 10 is turning at higher speeds. The present inventors have realized that during a turn, as indicated by arrow 32, an outer drive unit (in this case, drive unit 12*a*) incurs a substantially higher hydrodynamic load than an inner drive unit (in this case, drive unit 12*b*). Regarding the naming convention used herein with respect to an "outer" or "inner" drive unit, it should be understood that if the marine vessel 10 is making a turn to port, the drive units would be oriented at steering angles opposite those shown herein, the drive unit 12*a* would be considered the "inner drive unit" as it would be on the inside of the turn, and the drive unit 12*b* would be considered the "outer drive unit" as it would be on the outside of the turn.

Especially when the drive units are single-propeller units with the propellers both turning out (the propeller on drive unit 12*a* is turning in a counterclockwise direction, while the propeller on drive unit 12*b* is turning in a clockwise direction) hydrodynamic forces on the outer drive unit (here, drive unit 12*a*) are substantially higher than hydrodynamic forces on the inner drive unit (here, drive unit 12*b*). These hydrodynamic forces are caused both by the propeller itself as it pushes against the water, and by water moving off of the hull of the marine vessel 10 at the stern 28 and subsequently hitting each drive unit. For the outer drive unit, the water moving off the hull hits almost perpendicular to a skeg 52 (FIGS. 4-6) of the drive unit. In contrast, for the inner drive unit, water moving off the hull hits almost parallel to the skeg 52. This results in much higher forces on the outer drive unit than on the inner drive unit.

For example, in FIG. 1, the drive units 12*a*, 12*b* are single propeller drive units with propellers that are turning out. The force of the water on drive units 12*a*, 12*b* is shown by the arrows $F_W$ and the force of the propellers is shown by the arrows $F_P$. Because the propeller on inner drive unit 12*b* is turning in a clockwise direction, its force $F_P$ cancels to some extent with the force of the water $F_W$, resulting in substantially less hydrodynamic force on the inner drive unit 12*b*. In contrast, the force of the water $F_W$ and the force of the propeller $F_P$ on the outer drive unit 12*a* are additive (and therefore much higher), because the outer drive unit propeller is turning in a counterclockwise direction. Such unbalanced forces require a higher counter-acting force of the outer drive unit steering actuator (here, 42*a*) than of the inner drive unit steering actuator (here, 42*b*) to keep the drive units 12*a*, 12*b* steered to a requested steering angle. For example, when the steering actuators 42*a*, 42*b* are hydraulic actuators, more hydraulic pressure is required to steer the drive unit 12*a* to the desired steering angle in order to counteract the additive forces of the water $F_W$ and the propeller $F_P$. This not only creates inefficiencies in the steering system, but sometimes, the outer drive unit steering actuator's required counter-acting force is so high that the system encounters a diagnostic fault for failure to achieve the required counter-acting force.

Although the forces acting on the system are described with respect to single counter-rotating propellers that are turning out, the present systems and methods are applicable to single counter-rotating propellers that are turning in (the propeller on drive unit 12*a* is rotating in a clockwise direction and the propeller on drive unit 12*b* is rotating in a counterclockwise direction). The present disclosure is also applicable to drive units having dual, coaxial contra-rotating propellers rather than single propellers.

Figure 2:
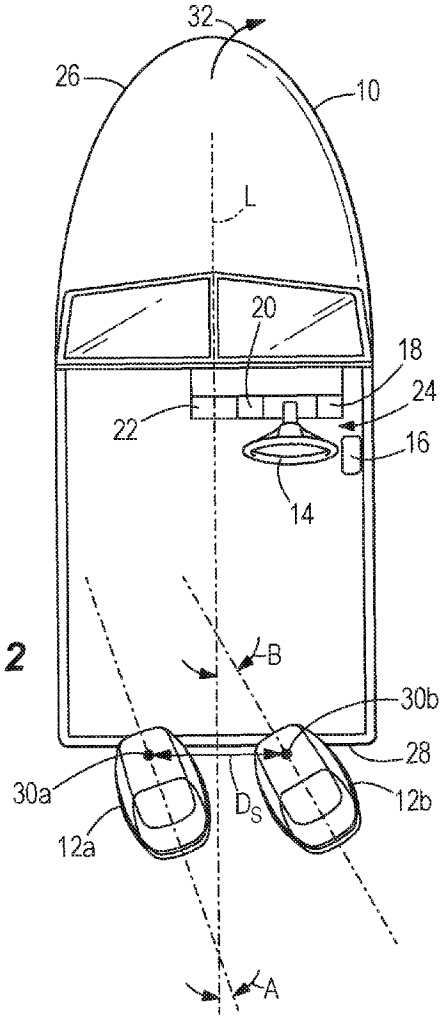
FIG. 2 is a schematic depiction of the marine vessel of FIG. 1, but with the drive units in different positions.

The present inventors have realized that by steering the drive units 12*a*, 12*b* to independent steering angles, the drive units 12*a*, 12*b* can be made to incur substantially the same hydrodynamic load while the marine vessel 10 is turning. With reference to FIG. 2, the present inventors have devised a system for controlling movement of a plurality of drive units 12*a*, 12*b* on a marine vessel 10, comprising a control circuit 34 (FIG. 3) communicatively connected to each drive unit 12*a*, 12*b* in the plurality of drive units. When the marine vessel 10 is turning, such as shown by arrow 32, the control circuit 34 defines one of the drive units in the plurality of drive units as an inner drive unit (in this case drive unit 12*b*) and another of the drive units in the plurality of drive units as an outer drive unit (in this case drive unit 12*a*). The control circuit 34 calculates an inner drive unit steering angle and an outer drive unit steering angle and sends control signals to actuate the inner and outer drive units to the inner and outer drive unit steering angles, respectively, so as to cause each of the inner and outer drive units to incur substantially the same hydrodynamic load while the marine vessel 10 is turning.

For example, the control circuit 34 calculates an inner drive unit steering angle B and an outer drive unit steering angle A. As will be described further herein below, an absolute value of the outer drive unit steering angle A is less than an absolute value of the inner drive unit steering angle B. For purposes of this example, when a drive unit 12*a*, 12*b* is steered in a counterclockwise direction around its vertical steering axis 30*a*, 30*b*, this is considered a positive steering angle. For example, drive units 12*a*, 12*b* in the examples shown in FIGS. 1 and 2 are steered to positive steering angles. If the drive units 12*a*, 12*b* were steered in a clockwise direction, this would be considered a negative steering angle. The absolute value of the steering angles is referred to in order to clarify that during a turn, both drive units 12*a*, 12*b* are steered in the same rotational direction (e.g., clockwise or counterclockwise when viewed from above) about their vertical steering axes 30*a*, 30*b*, but to different steering angles A, B. The ability of the system to steer the drive units 12*a*, 12*b* to independent steering angles, the degree of separation of which depends on a calibratable function of vessel speed, trim position, and engine speed, as discussed herein below, allows for hydrodynamic forces on each drive unit 12*a*, 12*b* to be substantially equalized.

Figure 4:
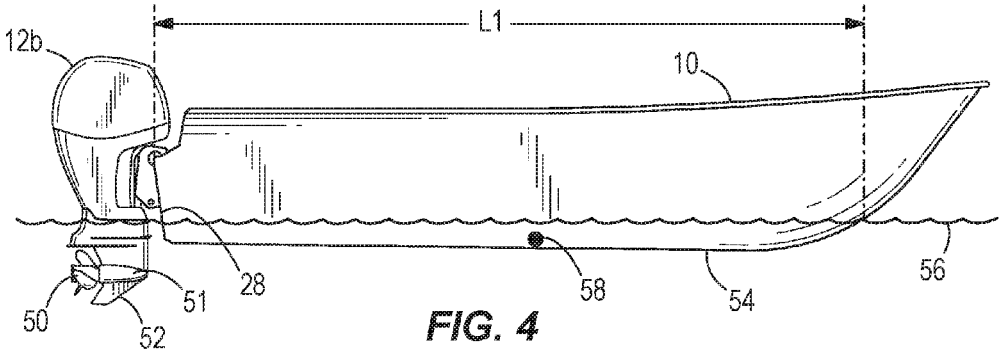
FIGS. 4-6 are side views of a marine vessel having a drive unit in various trim positions.
Figure 5:
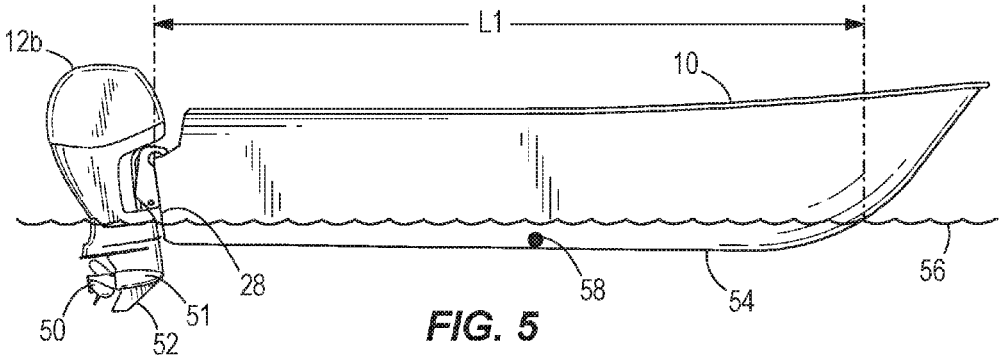
Figure 6:
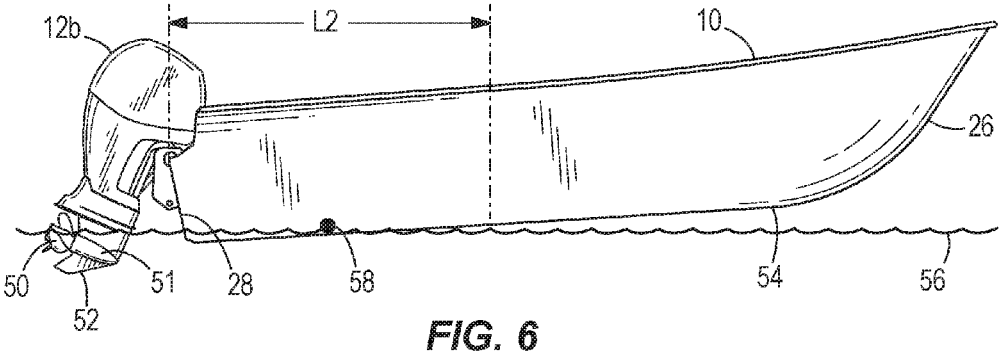

Several other aspects of the marine vessel 10 will be described before explaining how the control circuit 34 determines the steering angles A, B to which the drive units 12*a*, 12*b* are oriented. FIGS. 4-6 show a marine vessel 10 in a side view. The marine vessel 10 comprises more than one drive unit; however, because the marine vessel 10 is shown in a side view, only the drive unit 12*b* is shown in the FIGURES. The drive unit 12*b* comprises a gear case 51, a propeller 50 extending rearward from the gear case 51, and a skeg 52 extending downward from the gear case 51. The gear case 51, propeller 50, and skeg 52 are the portions of the drive unit 12*b* that incur the above-mentioned hydrodynamic loads from water, as water is pushed by the propeller 50 and as water moving off of a hull 54 of the marine vessel 10 hits the skeg 52 and gear case 51 close to perpendicular (at least on the outer drive unit).

In FIG. 4, the drive unit 12*b* is shown in a neutral trim position, in which the drive unit 12*b* is in more or less of a vertical position. In FIG. 5, the drive unit 12*b* is shown in a trimmed in (trimmed down) position. In FIG. 6, the drive unit 12*b* is shown in a trimmed out (trimmed up) position. The positions in FIGS. 4 and 5 are generally used when the marine vessel 10 is operating at slower speeds. For example, the trim position shown in FIG. 4 is often used when the marine vessel 10 is in a joysticking mode. The trim position in FIG. 5 is often used during launch of the marine vessel 10, before the marine vessel 10 has gotten up to speed and on plane. In contrast, the trim position shown in FIG. 6 is often used when the marine vessel 10 is on plane and high speeds are required. At high speeds, the trim position shown in FIG. 6 causes the bow 26 of the marine vessel 10 to rise out of the water 56 as shown.

In FIGS. 4 and 5, it can be seen that the hull 54 of the marine vessel 10 is wetted by the surface of the water 56 along a longitudinal length L1. In contrast, the hull 54 is wetted only along a longitudinal length L2 in FIG. 6. This is because the bow 26 of the marine vessel 10 rises out of the water 56 when the vessel on plane and operating at higher speeds. When the marine vessel 10 is turning, this wetted surface area is the area that is in contact with the surface of the water 56 and effectively operates as a pivoting area for the marine vessel 10. The present systems and methods contemplate determining a midpoint of this wetted surface area of the hull 54 in order to define what will hereinafter be referred to as "a center of effort." The center of effort is a virtual point on the marine vessel 10 that moves along the longitudinal axis L as a function of vessel speed and pitch attitude. In the examples shown herein, the center of effort can be thought of as the midpoint 58 of the wetted surface area of the hull 54. In these examples, it is referred to as the "midpoint" because it is approximately half the length of the wetted surface area of the hull 54. For example, in FIGS. 4 and 5, the midpoint 58 is approximately $L_1 \div 2$ away from the stern 28 of the marine vessel 10. In FIG. 6, the midpoint 58 is approximately $L_2 \div 2$ away from the stern 28 of the marine vessel 10.

The center of effort (or midpoint 58) is located approximately at the longitudinal position of the center of turn or center of gravity of the marine vessel 10, as these virtual points are described in U.S. Pat. Nos. 6,234,853 and 7,467,595. However, the center of effort differs from the center of turn or center of gravity described in those patents, because when the marine vessel 10 is turning at higher speeds, the center of turn and/or center of gravity is somewhere off to the side of the marine vessel 10 in the direction of the turn. In other words, the center of effort is not the true center of turn and/or center of gravity, which are suitable for calculations regarding slow-speed turning and movement of the marine vessel. Rather, the center of effort (midpoint 58) is a calibrated value that attempts to match the marine vessel's natural tendency during turns and that can change depending on the speed of the marine vessel 10, positions of trim tabs on the drive units 12*a*, 12*b*, pitch attitude of the marine vessel 10 (for example measured by an inertial measurement unit), trim angles of the drive units 12*a*, 12*b*, speeds of engines in the drive units, fuel load, length of the marine vessel 10, and/or shape and length of the hull 54. In this way, the center of effort represents the longitudinal location of a virtual axle (or pivot line 78, FIG. 8) of the marine vessel 10 during turning movements.

Approximate locations for the center of effort (midpoint 58) can be determined by driving the marine vessel 10 at different speeds and under different conditions and creating a table of calibrated values corresponding the different speeds and/or different conditions to approximate midpoints 58 of the wetted surface area of the hull 54. For example, during calibration, readings can be taken from pressure sensors located on or near each of the drive units, and the location of the midpoint 58 in the below-described calculations can be varied at one speed until the pressure readings from each drive unit are approximately equal. This process can then be repeated for different vessel speeds to create a look-up table. Further readings can be taken upon varying other factors/conditions such as the trim positions of the drive units, engine speed, etc., as mentioned above. A look-up table is only one example of how the center of effort may be stored and retrieved; other equations or models stored in the memory of the control circuit 34 could instead provide an estimate of the center of effort, such as, for example, those disclosed in Savitsky & Brown, Procedures for Hydrodynamic Evaluation of Planing Hulls in Smooth and Rough Water, Marine Technology, Vol. 13, No. 4 (October 1976), pages 381-400.

Figure 7:
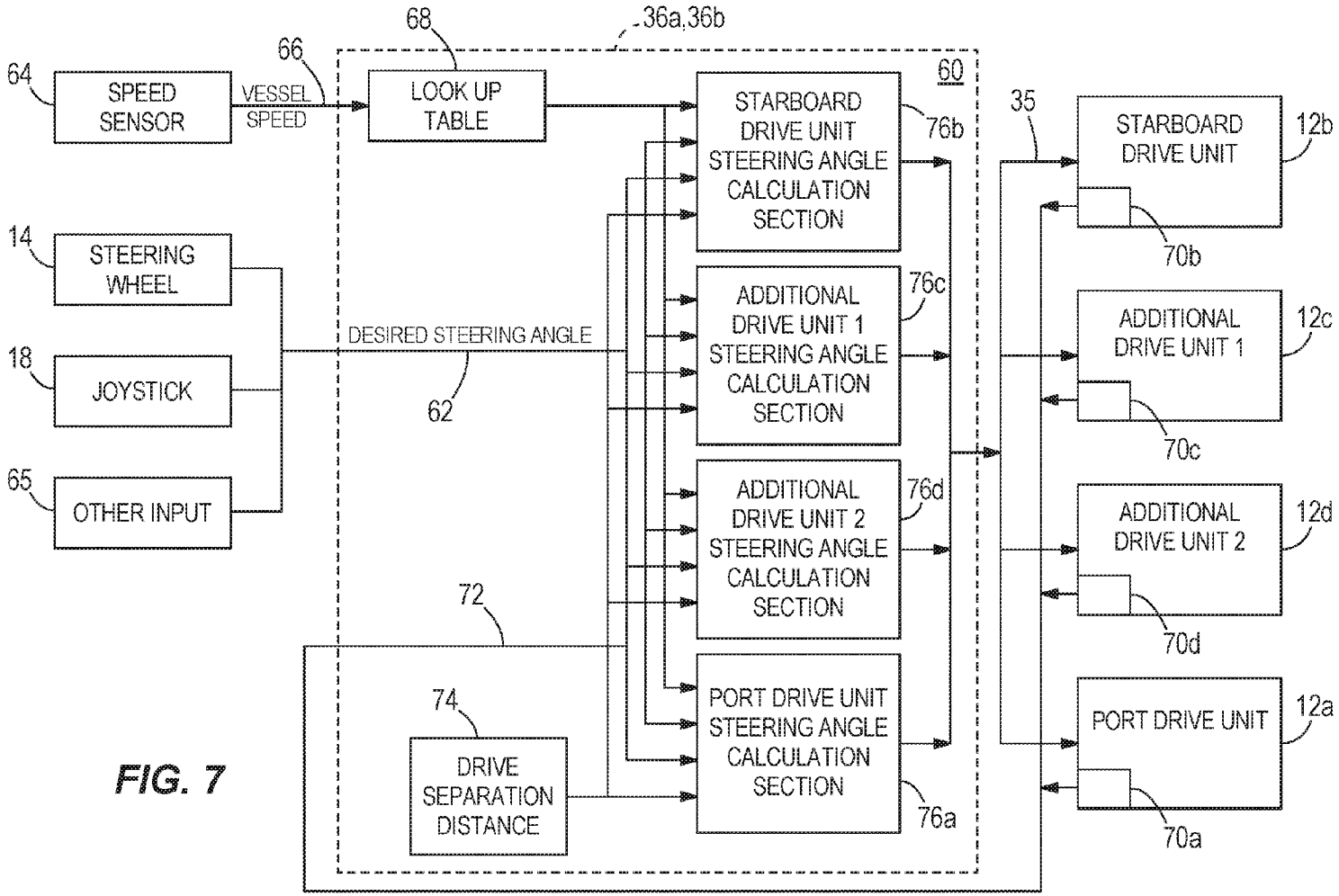
FIG. 7 is a schematic depiction of a logic circuit for carrying out one example of a method for controlling movement of a plurality of drive units on a marine vessel.

FIG. 7 shows an example logic circuit 60 that comprises part of the system and carries out the methods described herein. In one example, the logic may be contained in software loaded on one of the CCMs 36*a*, 36*b*. However, it should be understood that a separate module could be provided for carrying out the method described herein or that the method described herein could be carried out in any of the other above-described control modules. In the example shown in FIG. 7, the logic circuit 60 can be used with a marine vessel 10 having four drive units: a starboard drive unit 12*b*, a first additional drive unit 12*c*, a second additional drive unit 12*d*, and a port drive unit 12*a*. See also FIG. 8. In the embodiment shown, the additional drive units 12*c*, 12*d* are provided laterally between the port drive unit 12*a* and the starboard drive unit 12*b*. It should be understood that fewer or more drive units could be provided.

The logic circuit 60 receives inputs from several different sensors and/or input devices aboard the marine vessel 10. For example, the logic circuit 60 receives an input from the joystick 18 and/or the steering wheel 14. As described herein above, these two input devices 14, 18 allow the operator of the marine vessel 10 to cause the marine vessel 10 to turn by inputting a desired steering angle to the logic circuit 60. The desired steering angle could alternatively be input from another input device 65, such as for example an autopilot or yaw rate controller as described herein above. The desired steering angle is input along line 62 from whichever of the input devices 14, 18, 65 is controlling maneuvering of the marine vessel 10. The logic circuit 60 is also provided with an input from a speed sensor 64 along line 66. The speed sensor may be, for example, a pitot tube sensor, paddle wheel type sensor, or any other speed sensor 64 appropriate for sensing the actual speed of the marine vessel 10. In another embodiment, the speed sensor is not a physical sensor, but rather control logic that determines a speed of the marine vessel 10 from other sensed values, such as a rotational speed of the engines of the drive units. The speed of the marine vessel 10 is fed via line 66 into a look-up table 68 contained within the logic circuit 60. The look-up table 68 contains the calibrated values mentioned herein above regarding the distance of the midpoint 58 from the stern 28 of the marine vessel 10 based on speed. As described above, the look-up table 68 may also require inputs as to engine speed, fuel load, hull length, trim tab position, pitch attitude, etc., although such inputs are not shown herein.

Trim sensors 70*a*-70*d* are also provided for sensing trim angles of the drive units 12*a*-12*d*. The trim sensors 70*a*-70*d* may be any type of sensors known to those having ordinary skill in the art. The trim angles sensed by the trim sensors 70*a*-70*d* are sent via line 72 to the logic circuit 60. The logic circuit 60 can further be preloaded with a drive separation distance value, as shown at 74. In one example, the drive separation distance value 74 is the distance between the steering axes 30*a*, 30*b* of the drive units 12*a*, 12*b*, shown in FIG. 2 as $D_S$. Alternatively, the drive separation distance value 74 may be entered by the user, rather than being permanently stored in the logic circuit 60.

The logic circuit 60 further comprises steering angle calculation sections 76*a*-76*d* for each of the drive units 12*a*-12*d*. For example, the logic circuit 60 comprises a starboard drive unit steering angle calculation section 76*b*, a first additional drive unit steering angle calculation section 76*c*, a second additional drive unit steering angle calculation section 76*d*, and a port drive unit steering angle calculation section 76*a*. Each of the steering angle calculation sections 76*a*-76*d* carries out the methods described herein below. The logic circuit 60 compiles the information output from each steering angle calculation section 76*a*-76*d* and sends it via the CAN bus 35 to a respective drive unit 12*a*-12*d*. For example, this information is sent via the CAN bus 35 to steering control sections (FIG. 3), as described hereinabove. The steering control sections control steering actuators (FIG. 3) to actuate each drive unit 12*a*-12*d* to its respective steering angle.

Figure 8:
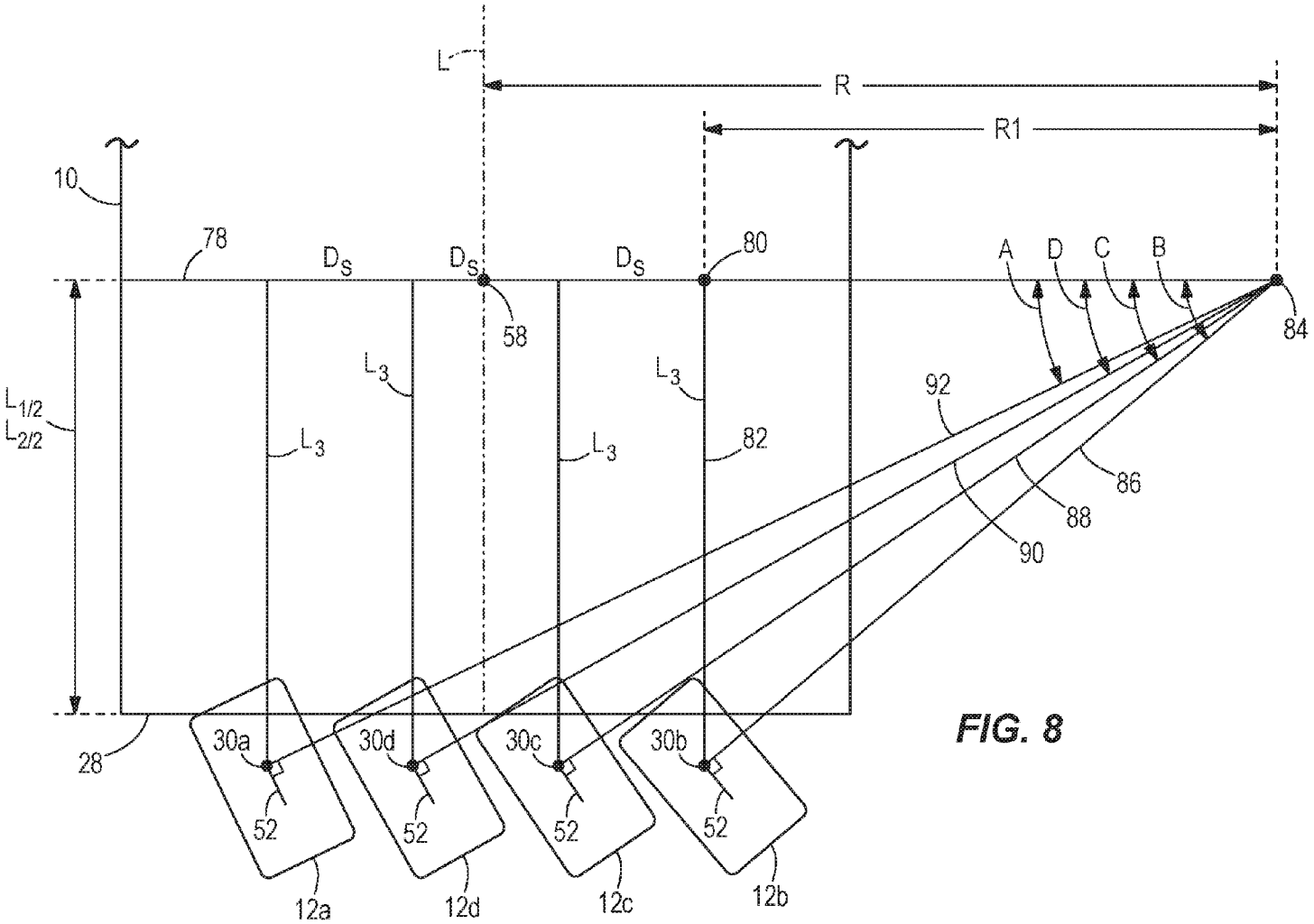
FIG. 8 is a schematic depiction of a rear portion of a marine vessel having a plurality of drive units and geometries associated therewith.

Now with reference to FIG. 8, which shows only the rear of a marine vessel 10, sample calculations for determining steering angles of each drive unit in a plurality of drive units will be described. In the example, all distances and points are assumed to be on a single plane for purposes of simplification of the calculations. Further, this plane is assumed to be viewed from above. In the example of FIG. 8, the marine vessel 10 has four drive units corresponding to the port drive unit 12*a*, additional drive unit 12*c*, additional drive unit 12*d*, and starboard drive unit 12*b* described hereinabove with respect to FIG. 7. Each of these drive units 12*a*-12*d* has a steering axis 30*a*-30*d*. As mentioned hereinabove, the steering axes 30*a*-30*d* are each separated by the same drive separation distance $D_S$. In alternative embodiments, the drive separation distances may be different between each of the drive units. Each drive unit 12*a*-12*d* extends at a respective steering angle A-D. Although these angles A-D are not drawn with respect to the longitudinal axis L, it should be understood that geometric principles apply such that each steering angle A-D shown in FIG. 8 has a corresponding angle of like degree that can be drawn as in FIGS. 1 and 2, which show the steering angles α, A, and B with respect to the longitudinal axis L.

In the example shown in FIG. 8, the midpoint 58 of the wetted surface area of the hull is shown. When viewed from above, a virtual pivot line 78 extends laterally through the midpoint 58 and perpendicular to the longitudinal axis L. The distance from the stern 28 to the pivot line 78 (which is the same as the longitudinal distance from the stern 28 to the midpoint 58) is labeled as $L_1/2$ or $L_2/2$ to correspond to FIGS. 4-6. In the example, the steering axes 30*a*-30*d* are shown somewhat longitudinally spaced from the stern 28 of the marine vessel 10. It should be understood that the distances shown in FIG. 8 are not necessarily to scale and the longitudinal spacing of the steering axes 30*a*-30*d* from the stern 28 of the marine vessel 10 is exaggerated for purposes of illustration. For purposes of the calculations described herein below, the control circuit 34 may use the distance from the stern 28 to the pivot line 78 as $L_1/2$ or $L_2/2$, or may alternatively take into account the longitudinal distance from the stern 28 to the steering axis 30*a*-30*d* of each drive unit 12*a*-12*d*. Alternatively, it may be desirable to take the trim angles of the drive units into account, as the trim angles may affect the distance between the point of application of hydrodynamic forces on the drive units and the pivot line 78, as can be seen by the difference between the longitudinal distance of the propeller 50 to the midpoint 58 in FIG. 4 and the longitudinal distance between the propeller 50 and the midpoint 58 in FIG. 5 (which is lesser because the drive unit 12*b* is trimmed in). For example, the calculations could include the longitudinal distance from the skeg 52 of each drive unit 12*a*-12*d* (see FIGS. 4-6) to the stern 28. In that case, the trim angle sensed by the trim sensors 70*a*-70*d* (FIG. 7) and input to each steering angle calculation section 76*a*-76*d* may be utilized to calculate the distance from the point of application of hydrodynamic force on each drive unit 12*a*-12*d* to the pivot line 78.

Although each of these separate distances (distance to steering axes 30*a*-30*d*, distance to skegs 52 based on trim angles, etc.) could be taken into account depending on the desired precision of the calculations, in the example shown in FIG. 8, only the distance between the steering axes 30*a*-30*d* and the stern 28 of the marine vessel 10 is taken into account. The below calculations therefore take into account the longitudinal distance of the pivot line 78 from the stern 28, determined using the look-up table 68 of FIG. 7, and the distance between each steering axis 30*a*-30*d* and the stern 28, which total distance is labeled as $L_3$.

According to the method of the present disclosure, when the control circuit 34 receives an operator request for a desired steering angle, the control circuit 34 sets the steering angle of the inner drive unit (in this case the starboard drive unit 12*b*) equal to the desired steering angle (in this case B). The control circuit 34 calculates a first intersection point 80 between the pivot line 78 and a line 82 extending through the steering axis 30*b* of the drive unit 12*b* and parallel to the longitudinal axis L. The control circuit 34 then calculates a second intersection point 84 of the pivot line 78 and a line 86 representing perpendicular application of hydrodynamic force on the inner drive unit 12*b*. In one example, the line 86 representing perpendicular application of hydrodynamic force on the first drive unit 12*b* is a line that extends perpendicularly to a skeg 52 of the first drive unit 12*b* when the marine vessel 10 is viewed from above. In other examples, this may be a line that extends perpendicularly to a propeller 50 or a gear case 51 of the first drive unit 12*b*. Of course, the lines representing perpendicular application of hydrodynamic force can only be approximated, as the skeg 52 and gear case 51 may have rounded surfaces and the propeller 50 is a spinning body. Therefore, it should be understood that each of these surfaces is only an approximation of the point of perpendicular application of hydrodynamic force on the body of the drive units for purposes of calculation.

The control circuit next determines an effective radius of rotation R1 of the inner drive unit 12*b* by calculating a distance between the first intersection point 80 and the second intersection point 84. The control circuit may calculate this radius R1 according to the equation: $R1=L_3 \div \tan(B)$. The control circuit 34 then calculates steering angles for each remaining drive unit (in this case drive units 12*a*, 12*c* and 12*d*) such that lines representing application of hydrodynamic force on each remaining drive unit (for example at each drive unit's skeg 52) intersect the pivot line 78 at the second intersection point 84. For example, each of lines 88, 90, and 92 intersect the pivot line 78 at the second intersection point 84. This provides the marine vessel 10 with an effective radius of rotation R (measured from the midpoint 58 to the second intersection point 84) that is the same for all drive units 12*a*-12*d*, and therefore evens the hydrodynamic load on each drive unit 12*a*-12*d*.

When the desired steering angle is positive, the control circuit 34 can calculate the drive angles A, B, C, D according to the equations:

$$B=\text{desired steering angle}$$

$$C=\text{arc tan}(L3 \div (R1+D_S))$$

$$D=\text{arc tan}(L3 \div (R1+2*D_S))$$

$$A=\text{arc tan}(L3 \div (R1+3*D_S))$$

When the desired steering angle is negative, the control circuit 34 can calculate the drive angles A, B, C, D according to the equations:

$$B=\text{arc tan}(L3\div(R1-3*D_S))$$

$$C=\text{arc tan}(L3\div(R1-2*D_S))$$

$$D=\text{arc tan}(L3\div(R1-D_S))$$

$$A=\text{desired steering angle}$$

The control circuit 34 then sends control signals to actuate each drive unit 12*a*-12*d* to its respective steering angle A-D.

Figure 9:
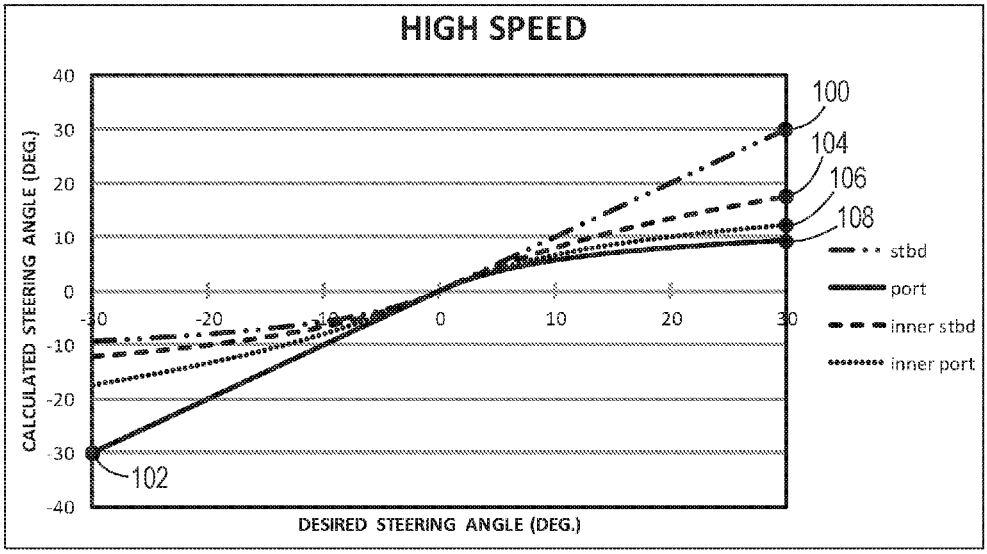
FIG. 9 is a chart showing one example of a result of carrying out the logic of FIG. 7 when a marine vessel is operating at a high speed.

Now referring to FIG. 9, an example of steering angle set points for a particular embodiment of a marine vessel operating at high speed will be described. The graph shown in FIG. 9 shows that for positive steering angles, when the starboard drive unit 12*b* is the inner drive unit, the calculated steering angle is equal to the desired steering angle. For example, at point 100, both the desired and calculated steering angles are 30 degrees. Similarly, for a turn to port, when the desired steering angle is negative and the port drive unit 12*a* is the inner drive unit, both the desired and calculated steering angles are −30 degrees, as shown at 102. Each of the remaining drive units has a steering angle having an absolute value that is less than the absolute value of the steering angle of the inner drive unit in either case (i.e., for both positive and negative desired steering angles).

For example, for positive desired steering angles, when the desired steering angle is 30 degrees, the inner starboard drive unit (12*c* in FIG. 8) has a calculated steering angle of approximately 17 degrees, as shown at 104. The exact value of the calculated steering angle depends on the inputs to the control circuit 34, such as the vessel speed, the desired steering angle, the trim angle, and the drive separation distance, as discussed above. As shown at 106, the inner port drive unit (12*d* in FIG. 8) has a calculated steering angle that is even less in absolute value than that of the starboard or inner starboard drive units, for example, 12 degrees. The port drive unit (12*a* in FIG. 8) has a calculated steering angle that is the least in absolute value, as shown at 108, for example, 9 degrees. The same principles apply for negative desired steering angles, where the absolute value of the calculated steering angle of the starboard drive unit 12*b* is less than the absolute value of the calculated steering angle of the inner starboard drive unit 12*c*, is less than the absolute value of the calculated steering angle of the inner port drive unit 12*d*, is less than the absolute value of the calculated steering angle of the port drive unit 12*a*. For any desired steering angle between −30 and 30 degrees, the same pattern holds true, although the degree of separation (along the vertical axis) of the desired and calculated steering angles decreases as the absolute value of the desired steering angle decreases. It should be understood that the 30 degree limits shown here are for exemplary purposes only, and greater steering angles are possible.

Figure 10:
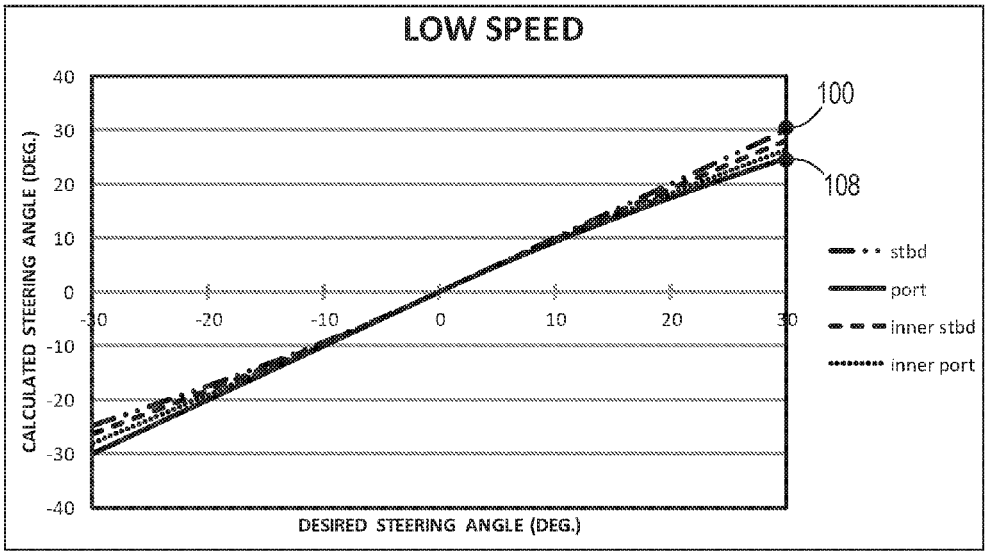
FIG. 10 is a chart showing one example of a result of carrying out the logic of FIG. 7 when a marine vessel is operating at a low speed.

It can be seen from comparison of FIGS. 9 and 10 that the calculated steering angles of each of the drive units 12*a*-12*d* in FIG. 10 do not vary to the same degree as the calculated steering angles shown in FIG. 9. This is because the look-up table 68 provided in the logic circuit 60 (FIG. 7) returns higher values of $L_3$ (or $L_1/2$ or $L_2/2$, whichever is preferred by the programmer of the control circuit 34) when the marine vessel 10 is operating at low speed than when the marine vessel 10 is operating at high speed. Referring back to FIGS. 4-6, because the midpoint 58 of the wetted surface area of the hull 54 (and therefore the pivot line 78) moves closer to the stern 28 of the marine vessel 10 at higher speeds of the marine vessel 10, this results in a lower value of $L_1/2$, $L_2/2$, or L3, whichever is used for purposes of calculation. In other words, the amount by which the absolute value of the outer drive unit steering angle is less than the absolute value of the desired steering angle is directly proportional to the speed of the marine vessel 10, according to the calibrated values provided in the look-up table 68. Visually, this is illustrated by the fact that the degree of separation between the points 100 and 108 along the vertical axis is less when the marine vessel is operating at low speed (FIG. 10) than when the marine vessel is operating at high speed (FIG. 9).

As described hereinabove, the amount by which the absolute value of the outer drive unit steering angle is less than the absolute value of the desired steering angle may also depend on trim angles of each of the drive units if the operator and/or programmer of the control circuit 34 wishes to factor in the distance from the propeller 50, gear case 51, or skeg 52 to the pivot line 78 for purposes of the calculations provided hereinabove.

Figure 11:
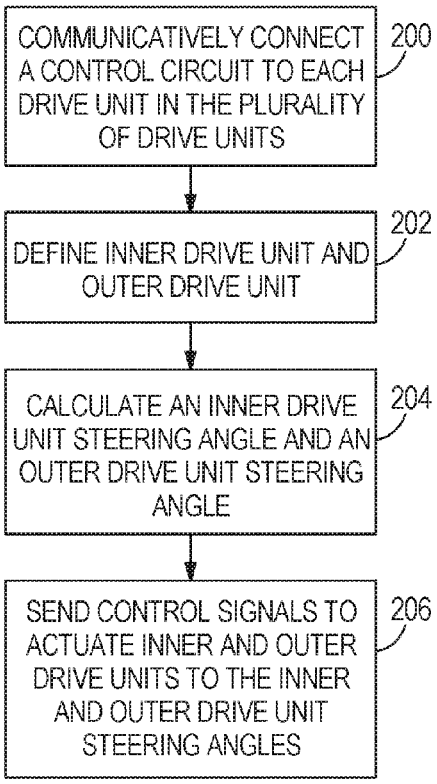
FIGS. 11 and 12 are flowcharts depicting other examples of methods for controlling movement of a plurality of drive units on a marine vessel.

Now with reference to FIG. 11, a method for controlling movement of a plurality of drive units 12*a*-12*b* on a marine vessel 10 will be described. The method of FIG. 11 will be described using the marine vessel 10 of FIG. 8 as an example; however, it should be understood that the inner drive unit need not be the starboard drive unit 12*b* (as in the following example) but could instead be the port drive unit 12*a*. The method comprises communicatively connecting a control circuit 34 to each drive unit 12*a*-12*d* in the plurality of drive units, as shown at 200. The method further includes defining an inner drive unit (e.g., 12*b*) and an outer drive unit (e.g., 12*a*) as shown at 202. The method next includes calculating an inner drive unit steering angle B and an outer drive unit steering angle A as shown at 204. The absolute value of the outer drive unit steering angle A is less than the absolute value of the inner drive unit steering angle B. The method includes sending control signals to actuate the inner and outer drive units 12*b*, 12*a* to the inner and outer drive unit steering angles B, A as shown at 206.

The method may further comprise receiving an operator input for a desired steering angle and setting the inner drive unit steering angle B equal to the desired steering angle. The method may further comprise determining a speed of the marine vessel 10, for example with a speed sensor 64, and based on the speed of the marine vessel, determining an amount by which the absolute value of the outer drive unit steering angle A is less than the absolute value of the desired steering angle. This may be done in part by using a look-up table 68. The method may further comprise determining trim angles of each of the inner and outer drive units 12*b*, 12*a*, for example with trim sensors 70*a*, 70*b*, and based on the trim angles, determining an amount by which the absolute value of the outer drive unit steering angle A is less than the absolute value of the desired steering angle. The method may further comprise calculating an additional drive unit steering angle of an additional drive unit (such as drive unit 12*c* and/or 12*d*) located between the inner drive unit 12*b* and outer drive unit 12*a*, wherein an absolute value of the additional drive unit steering angle C, D is less than the absolute value of the desired steering angle and greater than the absolute value of the outer drive unit steering angle A. The method may further comprise actuating each drive unit 12*a*-12*d* in the same rotational direction (e.g., counterclockwise as shown in FIGS. 1, 2 and 8) so as to turn the marine vessel 10.

Figure 12:
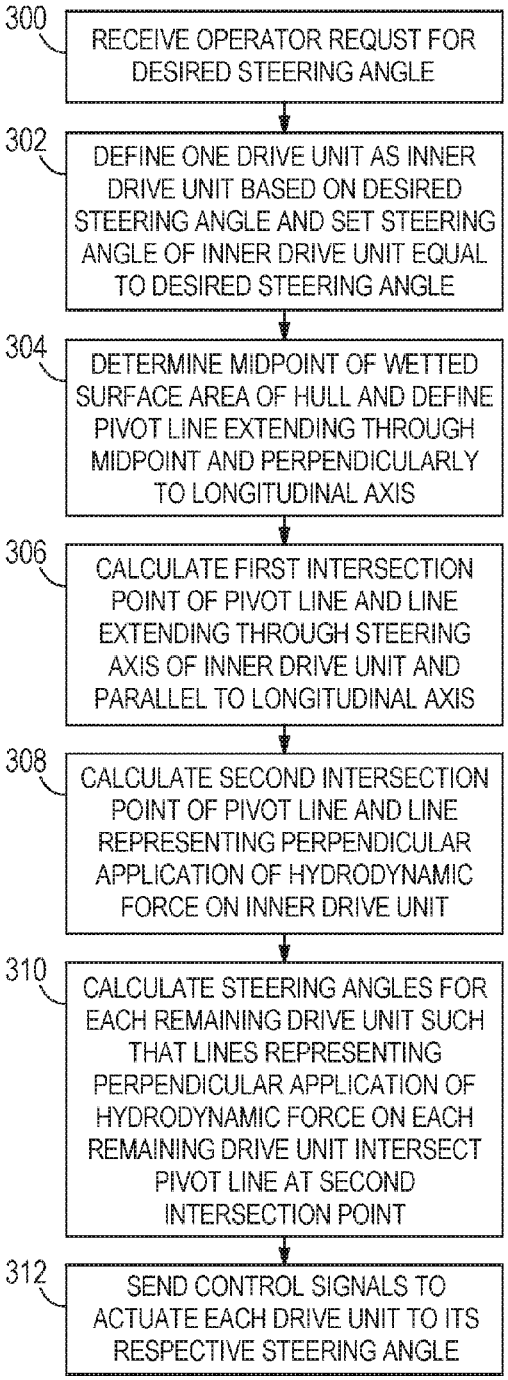

FIG. 12 depicts another method for controlling movement of a plurality of drive units 12*a*-12*d* on a marine vessel 10 having a hull 54 with a horizontally extending longitudinal axis L, each drive unit 12*a*-12*d* having a vertically extending steering axis 30*a*-30*d*. The method of FIG. 12 will be described using the marine vessel 10 of FIG. 8 as an example; however, it should be understood that the inner drive unit need not be the starboard drive unit 12*b* (as in the following example) but could instead be the port drive unit 12*a*. As shown at 300, the method comprises receiving an operator request for a desired steering angle. At 302, the method includes defining one of the drive units 12*a*-12*d* in the plurality as an inner drive unit based on the desired steering angle and setting a steering angle of the inner drive unit equal to the desired steering angle. For example, using the convention described herein, when the desired steering angle is positive, the starboard drive unit is the inner drive unit and when the desired steering angle is negative, the port drive unit is the inner drive unit. At 304, the method includes determining a midpoint 58 of a wetted surface area of the hull 54 and defining a pivot line 78 extending laterally through the midpoint 58 and perpendicular to the longitudinal axis L. In alternative examples, step 304 can be performed before or at the same time as steps 300 and 302.

As shown at 306, the method next includes calculating a first intersection point 80 of the pivot line 78 and a line 82 extending through the steering axis 30*b* of the inner drive unit 12*b* and parallel to the longitudinal axis L. At 308, the method includes calculating a second intersection point 84 of the pivot line 78 and a line 86 representing perpendicular application of a hydrodynamic force on the inner drive unit 12*b*. In one example, the line 86 representing perpendicular application of hydrodynamic force on the inner drive unit 12*b* is a line that extends perpendicular to a skeg 52 of the inner drive unit 12*b*.

At 310, the method includes calculating steering angles A, C, D for each remaining drive unit 12*a*, 12*c*, 12*d* in the plurality such that lines 92, 88, 90 representing perpendicular application of hydrodynamic force on each remaining drive unit 12*a*, 12*c*, 12*d* in the plurality intersect the pivot line 78 at the second intersection point 84. As shown at 312, the method next includes sending control signals to actuate each drive unit 12*a*-12*d* in the plurality to its respective steering angle A-D. In one example, the method further comprises sending control signals to actuate each drive unit 12*a*-12*d* in the plurality in the same rotational direction (e.g., clockwise or counterclockwise) in order to turn the marine vessel 10.

As discussed above with reference to FIG. 5, the method may further comprise determining a speed of the marine vessel 10 and inputting the speed of the marine vessel 10 into a look-up table 68 in order to obtain a calibrated estimate of the midpoint 58 of the wetted surface area of the hull 54. In one example, the midpoint 58 of the wetted surface area of the hull 54 moves toward a stern 28 of the marine vessel 10 as the speed of the marine vessel 10 increases.

It should be understood that various modifications could be made to the systems and methods described herein, and still fall within the scope of the present disclosure. For example, the steering angle of the inner drive unit may not be set to the desired steering angle. Instead, for example, one of the inner drive units' steering angles could be set to the desired steering angle and the calculations re-configured such that all lines representing perpendicular application of hydrodynamic force on the drive units intersect the pivot line 78 at the same intersection point. Further, this common intersection need not be exact, and the principles of the present application could be somewhat achieved by merely ensuring that the absolute value of the inner drive unit steering angle is the greatest of all the drive units' steering angles, even if the other drive units' steering angles do not have progressively lesser absolute values of steering angles.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims. Each limitation in the appended claims is intended to invoke interpretation under 35 U.S.C. §112(f), only if the terms "means for" or "step for" are explicitly recited in the respective limitation.

What is claimed is:

1. A method for controlling movement of drive units on a marine vessel, the marine vessel having a hull with a horizontally extending longitudinal axis and each drive unit having a respective vertically extending steering axis, the method being carried out by a control circuit and comprising:

receiving an operator request for a desired steering angle;

setting a steering angle of a first drive unit equal to the desired steering angle;

determining a midpoint of a wetted surface area of the hull;

defining a pivot line extending laterally through the midpoint and perpendicular to the longitudinal axis;

determining a first intersection point of the pivot line and a line extending horizontally through the first drive unit's steering axis and parallel to the longitudinal axis;

determining a second intersection point of the pivot line and a line representing perpendicular application of hydrodynamic force on the first drive unit;

setting a steering angle of a second drive unit such that a line representing perpendicular application of hydrodynamic force on the second drive unit intersects the pivot line at the second intersection point; and sending control signals to actuate the first and second drive units to their respective steering angles.

2. The method of claim 1, further comprising determining a speed of the marine vessel and inputting the speed of the marine vessel into a look-up table in order to obtain a calibrated estimate of the midpoint of the wetted surface area of the hull.

3. The method of claim 2, wherein the midpoint of the wetted surface area of the hull moves toward a stern of the marine vessel as the speed of the marine vessel increases.

4. The method of claim 2, wherein the first drive unit is more to an inside of a requested turn than the second drive unit, the inside of the requested turn being dictated by the desired steering angle.

5. The method of claim 4, wherein an absolute value of the second drive unit's steering angle is less than an absolute value of the first drive unit's steering angle.

6. The method of claim 5, wherein an amount by which the absolute value of the second drive unit's steering angle is less than the absolute value of the first drive unit's steering angle is directly proportional to the speed of the marine vessel.

7. The method of claim 1, wherein the lines representing perpendicular application of hydrodynamic force on the respective first and second drive units are lines that extend perpendicular to skegs of the first and second drive units, respectively.

8. The method of claim 1, further comprising sending control signals to actuate the first and second drive units in a same rotational direction in order to turn the marine vessel.

9. The method of claim 1, further comprising setting steering angles of third and fourth drive units such that lines representing perpendicular application of hydrodynamic force on the third and fourth drive units, respectively, intersect the pivot line at the second intersection point; and sending control signals to actuate the third and fourth drive units to their respective steering angles.

10. A method for controlling movement of drive units on a marine vessel, the marine vessel having a hull with a horizontally extending longitudinal axis and each drive unit having a respective vertically extending steering axis, the method being carried out by a control circuit and comprising:

receiving an operator request for a desired steering angle;

defining one of the drive units as an inner drive unit based on the desired steering angle;

setting a steering angle of the inner drive unit equal to the desired steering angle;

determining a midpoint of a wetted surface area of the hull;

defining a pivot line extending laterally through the midpoint and perpendicular to the longitudinal axis;

calculating a first intersection point of the pivot line and a line extending horizontally through the inner drive unit's steering axis and parallel to the longitudinal axis;

calculating an effective radius of rotation of the inner drive unit using the desired steering angle and a horizontal distance between the inner drive unit's steering axis and the first intersection point;

calculating a steering angle for another drive unit using the inner drive unit's effective radius of rotation and a separation distance between the inner drive unit and the other drive unit; and sending control signals to actuate the inner drive unit and the other drive unit to their respective steering angles.

11. The method of claim 10, further comprising calculating the inner drive unit's effective radius of rotation according to the equation $R_{EI}=D_{ST_FI}\div\tan(SA_I)$; wherein $R_{EI}$ is the inner drive unit's effective radius of rotation;

$D_{ST_FI}$ is the horizontal distance between the inner drive unit's steering axis and the first intersection point; and $SA_I$ is the inner drive unit's steering angle.

12. The method of claim 11, wherein calculating the other drive unit's steering angle comprises determining if the desired steering angle is positive or negative.

13. The method of claim 12, further comprising calculating the other drive unit's steering angle according to the equation $SA_2=\text{arc tan}(D_{ST_FI}\div(R_{EI}+D_S))$ when the desired steering angle is positive; wherein $SA_2$ is the other drive unit's steering angle; and $D_S$ is the separation distance between the inner drive unit and the other drive unit.

14. The method of claim 13, further comprising calculating the other drive unit's steering angle according to the equation $SA_2=\text{arc tan}(D_{ST_FI}\div(R_{EI}-D_S))$ when the desired steering angle is negative.

15. The method of claim 13, wherein the separation distance is a horizontal distance measured from the inner drive unit's steering axis to the other drive unit's steering axis.

16. The method of claim 10, further comprising determining a speed of the marine vessel and inputting the speed of the marine vessel into a look-up table in order to obtain a calibrated estimate of the midpoint of the wetted surface area of the hull.

17. The method of claim 16, wherein the midpoint of the wetted surface area of the hull moves toward a stern of the marine vessel as the speed of the marine vessel increases.

18. The method of claim 10, wherein calculating the inner drive unit's effective radius of rotation comprises:

calculating a second intersection point of the pivot line and a line representing perpendicular application of hydrodynamic force on the inner drive unit; and calculating a horizontal distance between the first intersection point and the second intersection point.

19. The method of claim 10, further comprising sending control signals to actuate the inner drive unit and the other drive unit in a same rotational direction in order to turn the marine vessel.

20. The method of claim 10, wherein an absolute value of the other drive unit's steering angle is less than an absolute value of the inner drive unit's steering angle.

* * * * *